United States Patent [19]

Nakamura et al.

[11] Patent Number: 4,879,574

[45] Date of Patent: Nov. 7, 1989

[54] COPYING APPARATUS HAVING AN AUTOMATIC DOCUMENT FEEDER AND AT LEAST TWO OPERATION MODES

[75] Inventors: Minoru Nakamura; Masazumi Ito, both of Toyohashi, Japan

[73] Assignee: Minolta Camera Kabushiki Kaisha, Osaka, Japan

[21] Appl. No.: 102,580

[22] Filed: Sep. 29, 1987

[30] Foreign Application Priority Data

Jun. 13, 1987 [JP] Japan ..... 62-147206

[51] Int. Cl.[4] ..... G03G 21/00

[52] U.S. Cl. ..... 355/204; 355/309; 355/314; 355/321

[58] Field of Search ..... 355/14 R, 14 SH, 35 H, 355/75, 203, 206, 210, 308, 309, 311, 313, 314, 321

[56] References Cited

U.S. PATENT DOCUMENTS

| | | | |
|---|---|---|---|
| 3,945,728 | 3/1976 | Crandell . | |
| 4,123,155 | 10/1978 | Hubert . | |
| 4,229,100 | 10/1980 | Travis . | |
| 4,285,591 | 8/1981 | Botte et al. . | |
| 4,317,629 | 3/1982 | Kuseski . | |
| 4,437,756 | 3/1984 | Kawakubo et al. . | |
| 4,477,178 | 10/1984 | Furuichi et al. . | |
| 4,501,485 | 2/1985 | Tsudaka . | |
| 4,537,497 | 8/1985 | Masuda . | |
| 4,620,782 | 11/1986 | Kurando et al. | 355/14 SH |
| 4,674,862 | 6/1987 | Abuyama | 355/14 SH |
| 4,730,204 | 3/1988 | Satoh et al. | 355/14 SH |

FOREIGN PATENT DOCUMENTS

| | | | |
|---|---|---|---|
| 55-111956 | 8/1980 | Japan . | |
| 22127 | 2/1985 | Japan | 355/14 SH |
| 150061 | 8/1985 | Japan | 355/14 SH |
| 95363 | 5/1986 | Japan | 355/14 R |
| 204626 | 9/1986 | Japan | 355/14 SH |
| 238041 | 10/1986 | Japan | 355/14 SH |
| 62-9367 | 1/1987 | Japan . | |

*Primary Examiner*—A. T. Grimley
*Assistant Examiner*—E. J. Pipala
*Attorney, Agent, or Firm*—Burns, Doane, Swecker & Mathis

[57] ABSTRACT

A copying apparatus comprises a document glass, an automatic document feeder that is free to be opened and closed with respect to the document glass, a paper feeding means, means for storing image formed papers and an image forming means. The image forming means is operable in a special paper-passing mode that permits the transfer paper to be ejected into the storing means without having the image formed thereon. The copying apparatus is provided with means for detecting the open and close actions of the automatic document feeder so that an alarm can be issued to remind the operator of the document left on the document glass according to the signal issued by the detecting means after the operation of the image forming means has been completed, and the operation of the alarm means can be inhibited after the operation of the image forming means in said paper-passing mode has been completed.

12 Claims, 12 Drawing Sheets

COPYING APPARATUS HAVING AN AUTOMATIC DOCUMENT FEEDER AND AT LEAST TWO OPERATION MODES

BACKGROUND OF THE INVENTION

1. Field of the Invention

The present invention relates to a copying apparatus having an automatic document feeder (hereinafter referred to as ADF), more particularly to a copying apparatus with a paper-passing function for enabling a transfer or copying paper to be discharged without having any image formed thereon.

2. Description of Related Art

Japanese Laid Open Patent No. SH62-9367 discloses a copying machine having what is called a paper-passing function that enables the sheets contained in the feed paper cassette to be discharged without having any image formed thereon.

Japanese Laid Open Patent No. SH055-111956 a copying machine provided with an ADF that can be either opened or closed freely to the platen glass. This copying machine is designed so that the ADF will not operate unless the ADF has been opened or closed after the forming of the image of the document set on the platen glass without using the ADF.

Further, U.S. Pat. No. 3,945,728 discloses a copying machine incorporating a device designed to enable an alarm when the operator has failed to remove the used document within a specified period of time by opening the platen cover following the finish of the copying operation of the machine.

All these prior arts, however, have not disclosed any device designed to relate the paper-passing function and the ADF or the alarm device for a forgotten document to each other.

SUMMARY OF THE INVENTION

Thus, an object of the present invention is to provide a more convenient copying apparatus wherein the paper-passing function, the ADF and the alarm device for forgotten documents are functionally related to each other.

To realize said object, the copying apparatus according to the present invention comprises a document glass, a document pressing means, a paper feeding means, a paper storing means, an image forming means capable of operating in both the normal copying mode and the paper-passing mode, a means for detecting the opening action of the document pressing means, an alarming means for forgotten document and mean for inhibiting the operation of the alarming means after the completion of the operation in the paper-passing mode. The alarming means issues the alarm when the detecting means has failed to detect the release action of the document pressing means within the specified period of time after the operation in the normal copying mode has been completed.

Further, the copying apparatus according to the present invention is provided with a ADF that can be opened or closed freely to the document glass. The document can be set on the glass either automatically by the ADF or manually when the operator has opened the ADF. Further, the copying apparatus is provided with second control means that permits the operation in the copying mode with a document set by the ADF, irrespective of the detection signal from the detecting means, after the operation in the paper-passing mode has been completed.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF A PREFERRED EMBODIMENT OF THE INVENTION

An embodiment of the copying apparatus according to the present invention will be explained in reference to the attached drawings.

(Copying Machine)

Figure 1:
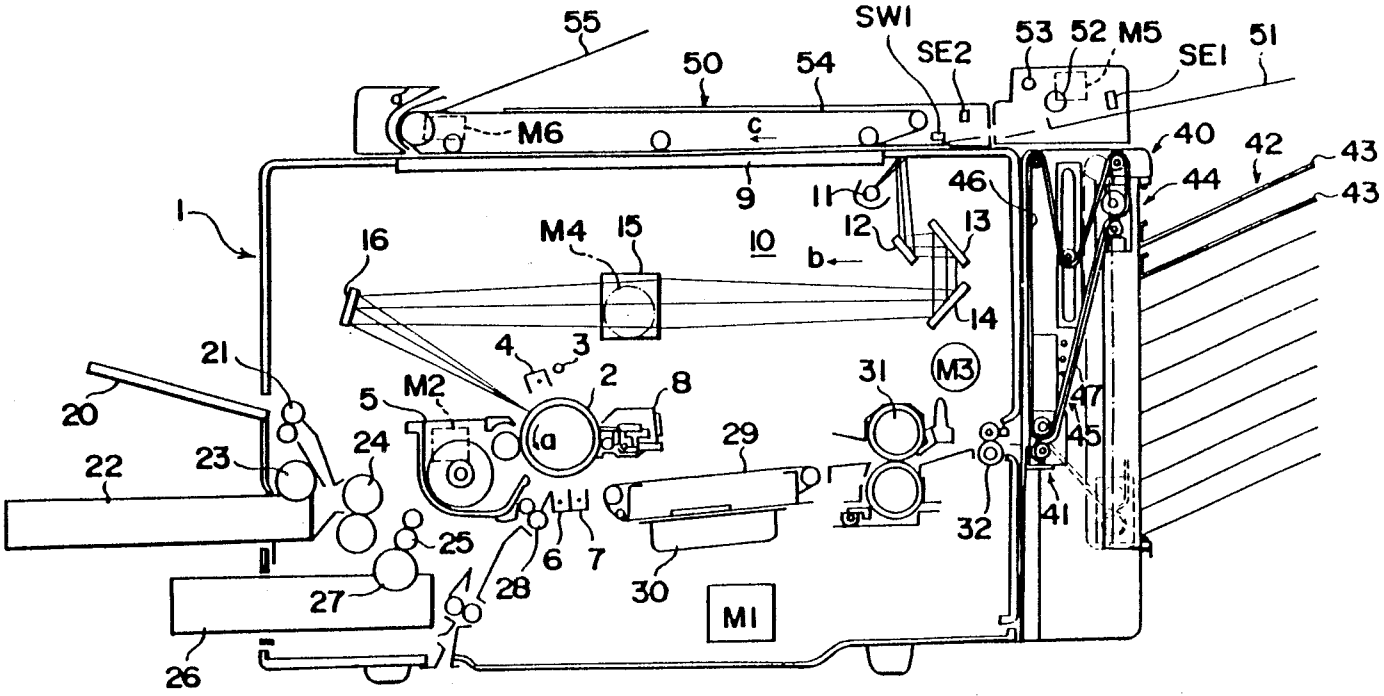
FIG. 1 is a schematic block diagram showing one embodiment of a copying apparatus in accordance with the invention.
Figure 2:
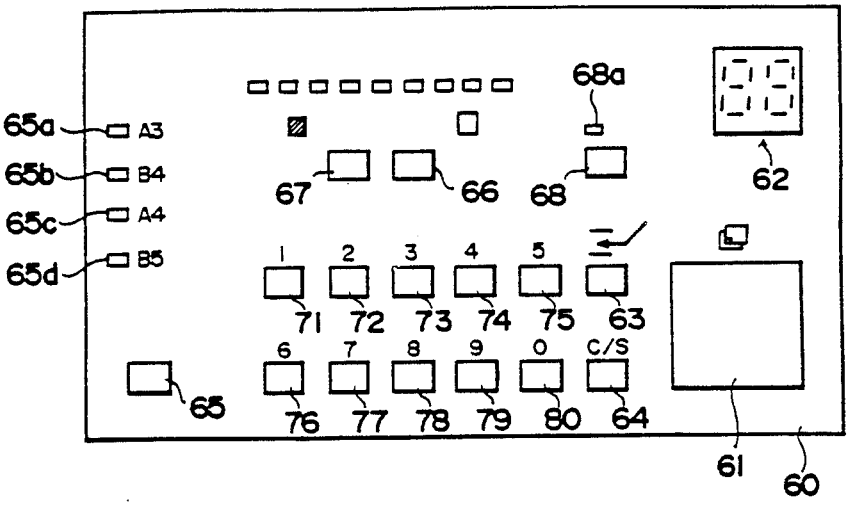
FIG. 2 is a plan view showing an operation panel of the copying machine.

FIG. 1 shows the copying machine 1 wherein a photosensitive drum 2 which rotates in the direction of an arrow (a) when driven is disposed at almost the center of the copying machine 1, and around the photosensitive drum 2 are disposed an eraser lamp 3, a static electricity charger 4, a magnetic brush type developing device 5, a transfer charger 6, a transfer paper separation charger 7 and a blade type cleaning unit 8. The photosensitive drum 2 has a photosensitive layer on its surface. The photosensitive layer is charged as it passes the charger 4 and exposed to the image of the document set on a document glass 9 through an optical system 10.

The optical system 10, which comprises an exposure lamp 11, moving mirrors 12, 13 and 14, a lens 15 and a mirror 16, is disposed under the document glass 9 so that the optical system 10 will be able to scan the image of the document from under the document. The exposure lamp 11 and the moving mirror 12 move in the direction of an arrow (b) at a velocity of (v/n) (n: magnification ratio) to the peripheral speed (v) of the photosensitive drum 2, while the moving mirrors 13 and 14 move in the same direction at a velocity of (v/2n). Said movements are made through the drive by a DC motor M3. To alter the magnification ratio, the lens 15 moves along the optical axis, and the mirror 16 moves and oscillates. Said movements are made by a motor M4.

On the other hand, an open-and-closeable manual paper feeding plate 20 and paper feeding cassettes 22 and 26 loaded with transfer papers are disposed on the left of the copying machine 1. The transfer papers are fed one by one by means of the rotations of a first and a second paper feeding rollers 23 and 27 or through the manual paper feeding plate 20. The transfer paper fed from the manual paper feeding plate 20 is transported to a timing roller couple 28 passing through roller couples 21, 24 and 25. The transfer paper fed from the roller couples 24 and 25, and the transfer paper from the cassette 26, passes directly to the same timing roller couple 28, where the transfer paper stops once. Then, the transfer paper at the timing roller couple 28 is synchronized with the image formed on the surface of said photosensitive drum 2 and transported to the transfer portion to come into close contact with the photosensitive drum 2 where the image formed with the toner is transferred onto said transfer paper by means of the corona discharge of the transfer charger 6. The transfer paper is then separated from the photosensitive drum 2 by means of the AC corona discharge of separation charger 7 and the restoring force of the transfer paper itself.

Then, the transfer paper is drawn onto the conveyor belt 29 which is provided with an air suction unit 30 in order to be conveyed to the fixing unit 31 where the toner image is fixed to the transfer paper, and the transfer paper is ejected by a ejection roller couple 32.

The aforementioned transporting system is driven by a motor M1. On the other hand, the photosensitive drum 2 which has completed its forming operation has the residual toner and the charge on its surface removed by the cleaning unit 8 and the eraser lamp 3 to prepare for the next copying process.

The copying machine 1 operates in a paper-passing mode as well as in the copying mode. In this paper-passing mode, the identification sheets such as the color sheets loaded in the cassette 22 or 26 are fed in the number set by ten keys 71 through 80, and these sheets are ejected through the ejection roller couple 32 without being involved in the copying operation, in case of need, are distributed by a sorter 40.

(Automatic Document Feeder (ADF))

The ADF 50 roughly comprises a document tray 51, a document feed belt 54 and a document ejection tray 55, and the while ADF 50 can be lifted round its supporting point located at its far side to uncover the document glass 9. Thus, the ADF 50 set on the document glass 9 automatically takes one document at a time from the document tray 51 to feed it to the specified position on the document glass 9 where it stops for carrying out the copying operation, and the ADF 50 also permits the operator to lift it for setting the document manually on the document glass 9 for carrying out the copying operation.

The open and close actions of the ADF 50 are detected as on and off by a switch SW1.

The documents are placed on the document tray 51 with the sides bearing the images downside and are detected by a sensor SE1. The documents are picked up, one at a time, by a pickup roller 52, and the document picked up is carried towards the direction of an arrow (c) of the feed belt 54 until it reaches the specified position on the document glass 9. When the rear end of the document in transit is detected by a sensor SE2, a predetermined timer is actuated, and, when the rear end of the document has arrived at the specified point on the document glass 9 where the image exposure scanning starts, the feed belt 54 stops rotating.

The copying operation takes place under the above-described conditions, and, when the image scanning for the document whose number has been set by ten keys 71 through 80 is completed, the feed belt 54 is redriven to cause the document to be ejected onto the ejection tray 55.

Said pickup roller 52 is driven by a motor M5, and said feed belt 54 by a motor M6 respectively.

Where the copying operation has been completed without using the ADF 50, the ADF 50 inhibits the operation for feeding document from the document tray 51 from starting unless the open-and-close operation of the ADF 50 has taken place once. This is because there is the possibility of the troubles such as the jamming or damage to of the document where the document is fed without knowing that one of the previous documents has been left on the document glass 9. As described before, however, when the operation in the paper-passing mode is completed, the operation to feed the document from the document tray 51 is permitted.

The ADF 50 is provided with a forgotten document reminding buzzer 53. This buzzer 53 is actuated to remind the operator of the document left on the document glass 9 when the switch SW1 has not detected the clearance of the document within a predetermined period time after the copying operation without using the ADF 50 has been completed. When the paper-passing mode operation is executed, the buzzer 53 will not be actuated even when the document glass 9 is not set free, regardless of the on or off condition of the switch SW1.

(Sorter)

The sorter 40 is connected to the copying machine 1 and comprises a receiving unit 41, a bin assembly 42 having a plural number of bins 43 and so on arranged vertically, a send-out unit 44 that is movable in a vertical direction, an endless belt 46 and a transport unit 45 that includes a retractable tape 47.

The transfer paper ejected from the ejection roller couple 32 of the copying machine 1 is received by the receiving unit 41 and sent out to each bin 43 from send-out unit 44 passing the transport unit 45. When a sensor provided at the exit of the send-out unit 44 but not shown in the drawings has detected and confirmed that a sheet of transfer paper has been sent out completely, the send-out unit 44 moves to the position that is opposite to the entrance to the bin 43 at the bottom level to feed the transfer paper to the bin 43 at the bottom level. In this way, the transfer papers are distributed among the bins 43 and so on one by one, and, when the distribution is completed, the send-out unit 44 returns to its starting position that is opposite to the bin 43 at the top level to wait for the transfer paper distribution for the next document. The sorter 40 is capable of distributing the transfer papers not only in the normal copying mode operation but also in the paper-passing mode operation.

(Operation Panel)

An operation panel 60 has a print key 61 for starting the copying operation, a numerical indicator 62 for indicating 2-figure numeric value, ten keys 71 through 80 corresponding to the numeric values ranging 1 through 0 respectively, an interruption key 63 for specifying the copying operation through interruption, a clear/stop key 64, a transfer paper selection key 65 for specifying one of the paper feeding cassettes 22 and 26, size-indication LEDS **65*a*, 65*b*, 65*c* and 65*d* for indicating the size of the transfer paper loaded in the cassette selected by the transfer paper selection key 65, an up key 66 and a down key 67 for altering the depth of the color by stages and specifying the depth of the color of the formed image, a paper-passing mode selection key 68 and a paper-passing mode indication LED 68***a*. The paper-passing mode selection key 68 selects or cancels the paper-passing mode repeatedly each time it is turned on, and the paper-passing mode indication LED 68*a* lights when the paper-passing mode is selected.

(Control Circuit)

Figure 3A:
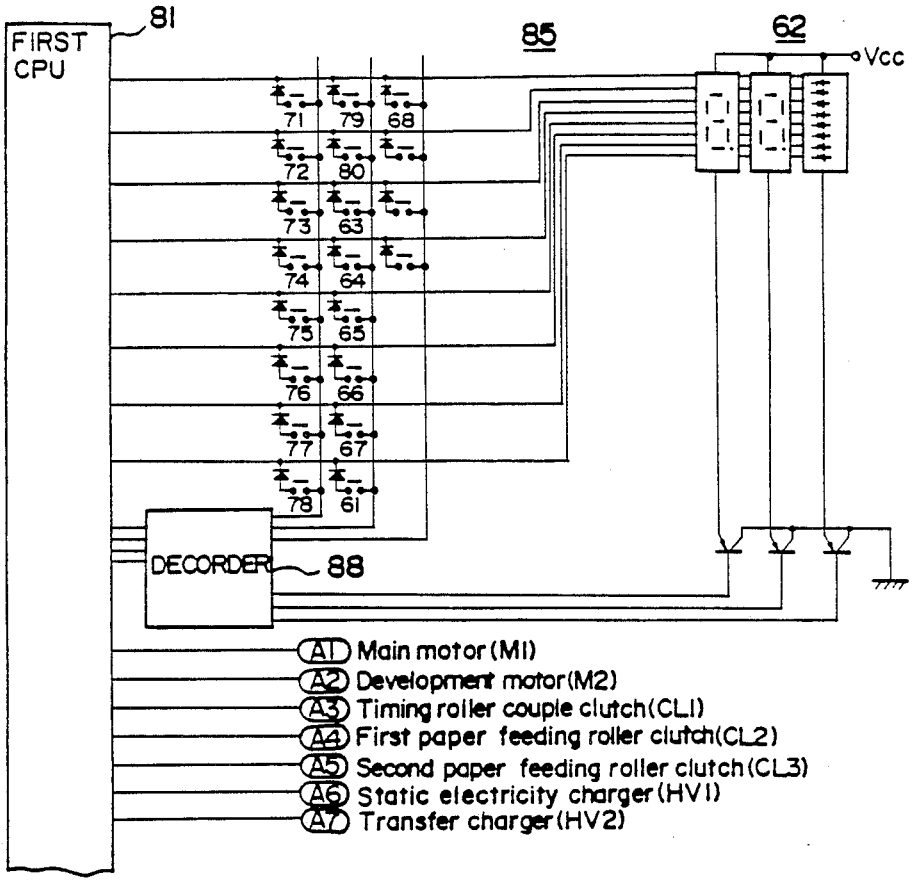
FIG. 3*a* and FIG. 3*b* are block diagrams showing a control circuit.
Figure 3B:
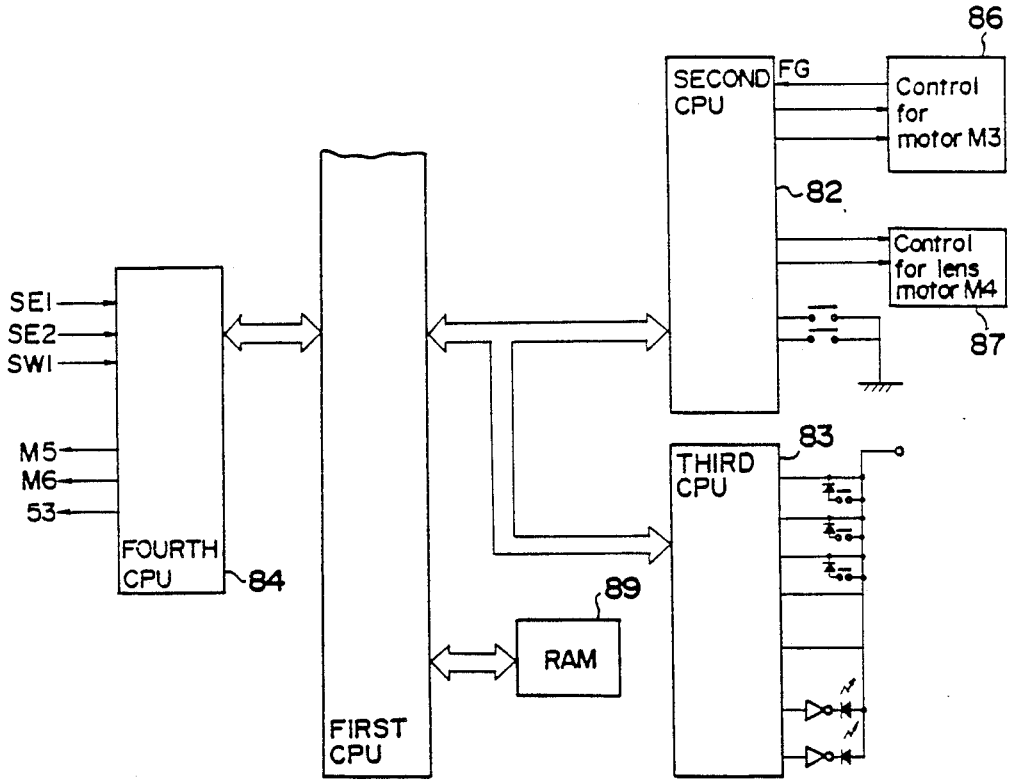

Here, the explanation will be made as to the control circuit in reference to FIG. 3*a* and FIG. 3*b*.

The control circuit comprises a first microcomputer 81 (hereinafter referred to as CPU) for controlling the copying operation, a second CPU 82 for controlling the optical system, a third CPU 83 for controlling the sorter, a fourth CPU 84 for controlling the ADF, a switch matrix 85, a drive circuit 86 of the DC motor M3 for document scanning operation, a drive circuit 87 of the stepping motor M4 for the change of magnification ratio, a decoder 88 and a random access memory 89 (hereinafter referred to as RAM). The output terminals A1 through A7 are connected to the main motor M1, the motor M2 for developing device, a clutch CL1 of the timing roller couple 28, a clutch CL2 of the first paper feeding roller 23, a clutch CL3 of the second paper feeding roller 27, the charger 4 and the charger 6 respectively.

The fourth CPU 84 receives the inputs of a signal informing a presence or absence of the document in the document tray 51 detected by the sensor SE1, a document transport detection signal from the sensor SE2 and an ADF open/close detection signal from the switch SW1. Further, the fourth CPU 84 outputs drive signals for driving the document feed motor M5 and the document transport motor M6 and an on-signal to the alarm buzzer 53.

(Processing Procedure)

Here, the explanation will be made as to the processing procedure by the aforementioned control circuit, especially the processing procedures of the copying operation mode and the paper-passing operation mode by the first CPU 81 and the processing procedure of the ADF 50 by the fourth CPU 84.

The explanation concerning the control of the optical system 10 by the second CPU 82 and the control of the sorter 40 by the third CPU 83 is omitted here, since it is publicly known already.

Figure 4:
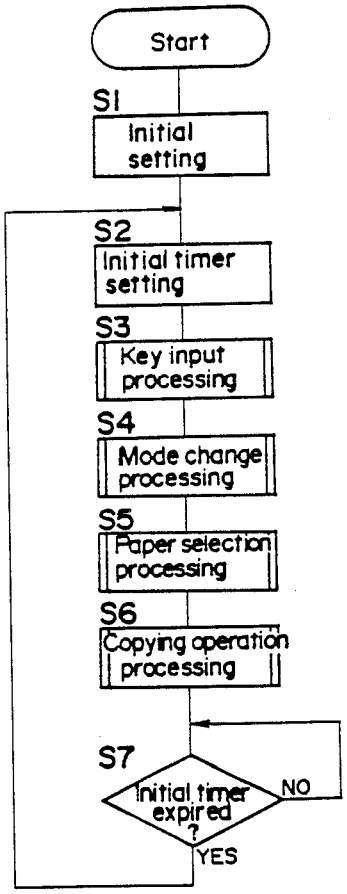
FIG. 4 is a flow chart showing a main routine of a first CPU.

FIG. 4 shows a main routine of the first CPU 81.

When the first CPU is reset, and the program is started, RAM 89 is cleared at step S1; the settings of various registers are initialized; and the initial setting is made for setting the equipment to the initial mode. Then, at step S2, an internal timer whose value has been set in advance at the time of the initial setting is started. Then, at steps S3, S4, S5 and S6, subroutines, which will be explained later, are called sequentially. When the processings of all the subroutines are over, at step S7, whether or not the internal timer which has been set initially is expired is judged, and a routine is terminated by waiting for the expiration of the internal timer, and then the processing returns to step S2. The length of time required for one routine is used to make the count for the various timers used in each subroutine. The values of various timers are used for judging the expiration of the timer by the umber of times of the count made for one routine.

The first CPU 81 is used for the data communication with other CPUs 82, 83 and 84 after calling all the subroutines.

Figure 5:
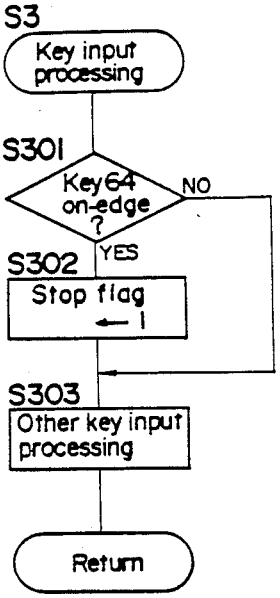
FIG. 5 is a flow chart showing a subroutine for a key input processing.

FIG. 5 shows a subroutine for the key input processing to be executed at step S3.

First, at step S301, whether the clear stop key 64 is on-edge or not is judged. When on-edge, the stop flag is set to "1" at step S302. Later, and, when the clear stop key 64 has not been turned on, at step S303, the processing for the key input by the key other than the clear stop key 64 is executed to terminate this subroutine.

Figure 6:
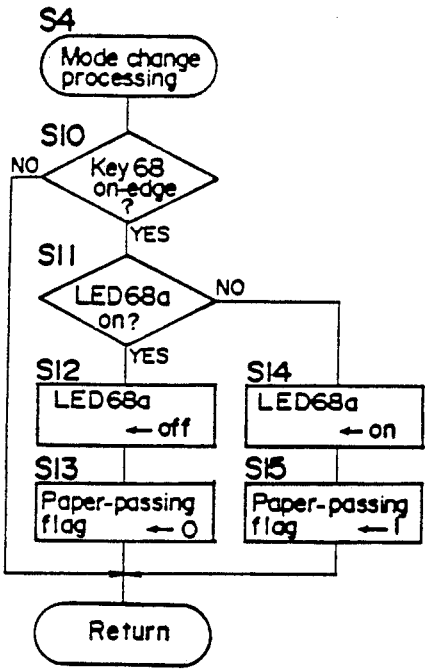
FIG. 6 is a flow chart showing a subroutine for a mode change processing.

FIG. 6 shows a subroutine for the mode change processing to be executed at step S4.

First, when the paper-passing mode selection key 68 is judged to be on-edge at step S10, on/off of the paper-passing mode indication LED 68*a* is judged at step S11. When the paper-passing mode indication LED 68*a* is on where the paper-passing mode selection key 68 is on-edge, that is, when the paper-passing mode selection key 68 is depressed again after the paper-passing mode has already been selected, the paper-passing mode indication LED 68*a* is turned off at step S12, and the paper-passing flag is reset to "0" to cancel the paper-passing mode and to make the return to the main routine. Conversely, the paper-passing mode indication LED 68*a* is off where the paper-passing mode selection key 68 is on-edge, the paper-passing mode is judged to have been selected at this stage, and the paper-passing mode indication LED 68*a* is turned on at step S14; the paper-passing flag is set to "1" at step S15; and the processing returns to the main routine.

When the paper-passing mode selection key 68 is not set to the timing of on-edge, the processing immediately returns to the main routine.

Figure 7A:
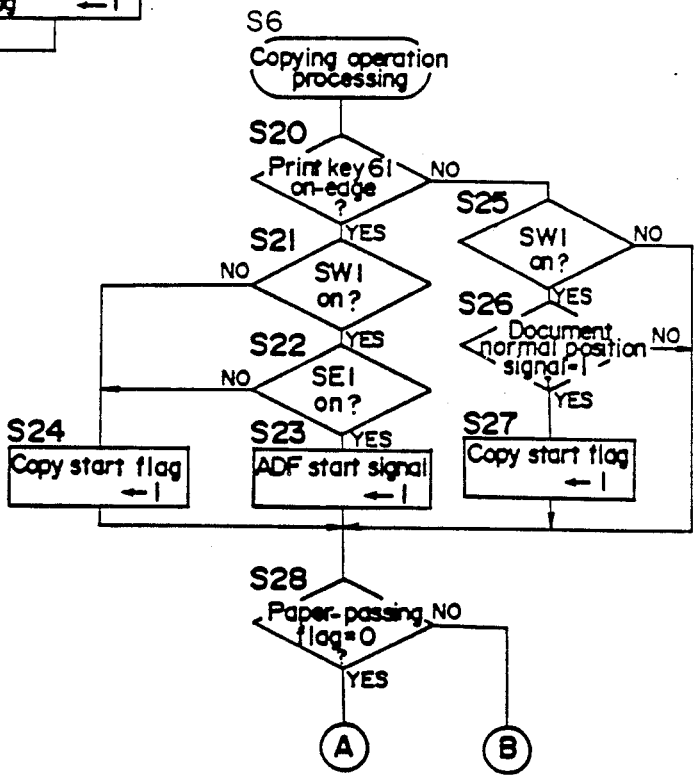
FIG. 7*a*, FIG. 7*b* and FIG. 7*c* are flow charts showing a subroutine for a copying operation processing.
Figure 7B:
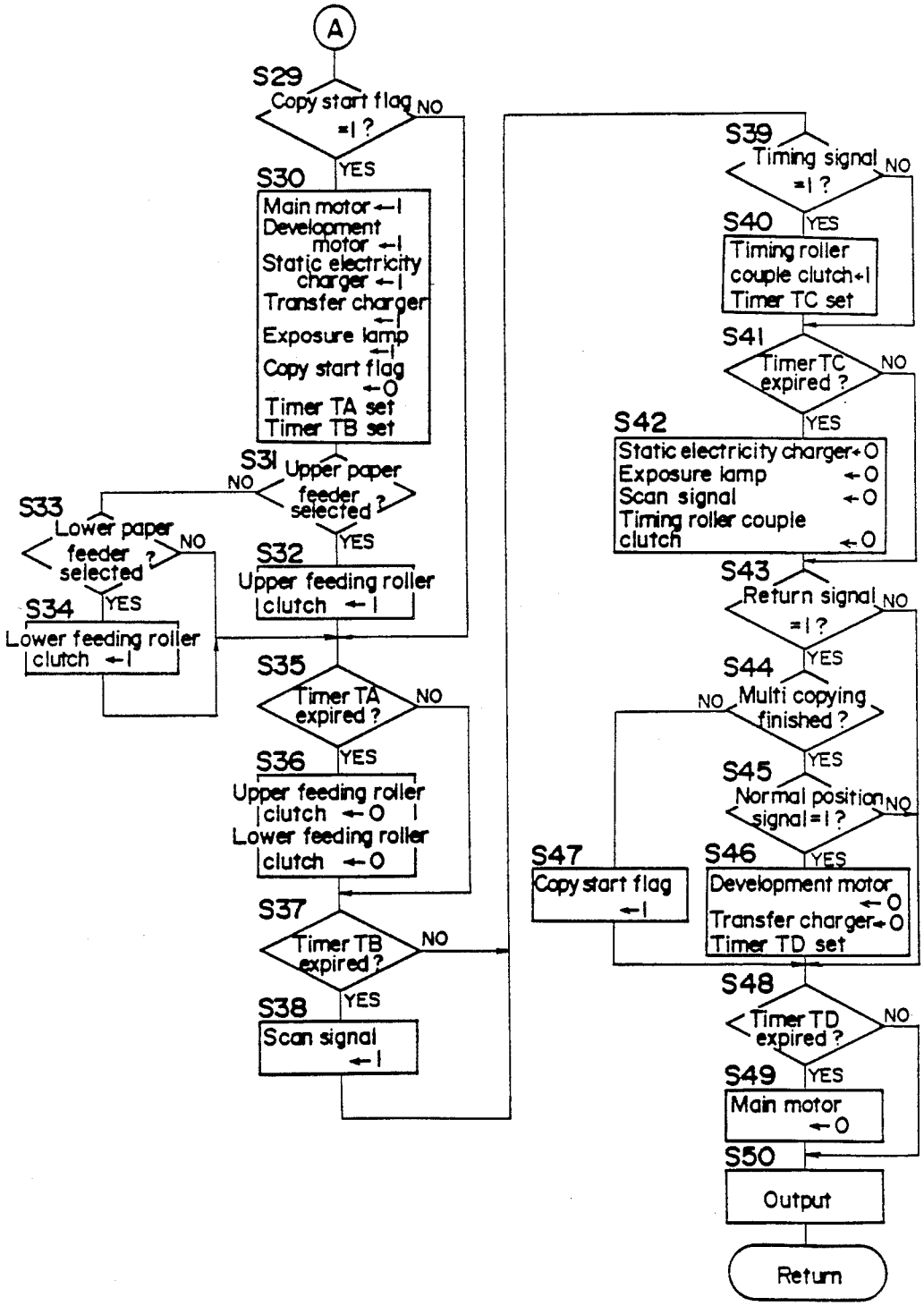
Figure 7C:
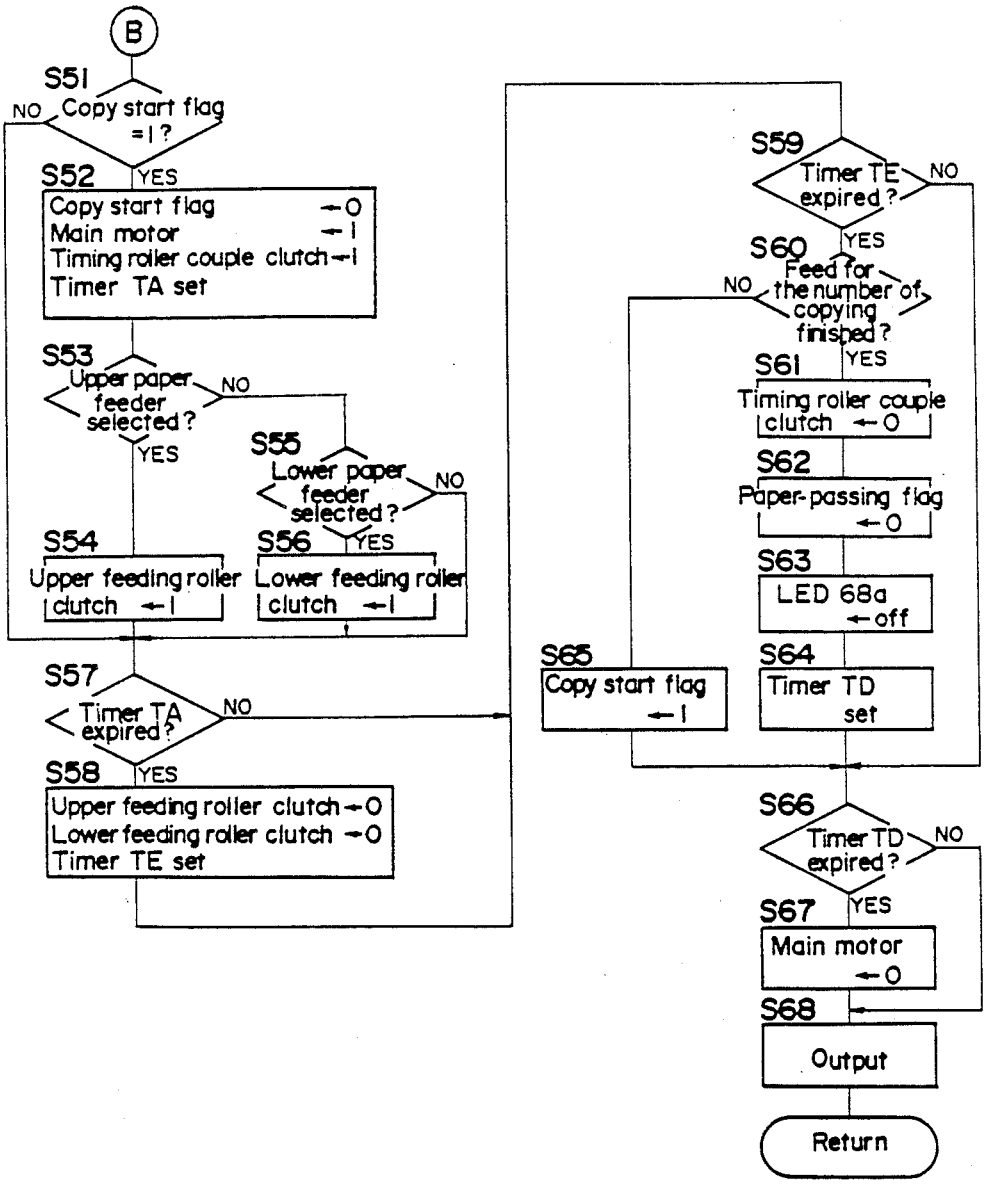

FIG. 7*a*, FIG. 7*b* and FIG. 7*c* show a subroutine for the copying operation processing to be executed at step S6.

First, whether the print key 61 is on-edge or not is judged at step S20. When on-edge, whether the switch SW1 is on or not, that is, whether the ADF 50 is closed or not is judged at step S21. When the ADF 50 is open, the copy start flag is set to "1" at step S24, and the processing goes to step S28. When the ADF 50 is closed, whether the document is on the document tray 51 or not is judged at step S22 depending on the position (on or off) of the sensor SE1. When the presence of the document is indicated by the sensor SE1, the ADF start signal is set to "1" at step S23, and the processing goes to step S28. That is, when the ADF 50 is closed, and the document is set on the document tray 51 at the time when the print key 61 is turned on, ADF start signal is set to "1", and, otherwise, set the copy start flag to "1".

On the other hand, when the print key 61 is judged to be not on-edge at said step S20, whether the switch SW1 is on or not is judged at step S25. When on, whether the document normal position signal is set to "1" or not is judged at step S26. This document normal position signal is set to "1" when the document is set to the normal position on the document glass 9 by the ADF 50 (refer to step S139). When the document normal position signal is set to "1", set the copy start flag to "1" at step S27, and the processing goes to step S28. When the document normal position signal is set to "0", the processing goes to step S28.

Then, at step S28, whether the paper-passing flag is set to "0" or not is judged. The paper-passing flag is set to "1" when the paper-passing mode is selected (refer to step S15). When the paper-passing flag is set to "0", the copying mode operation is executed at steps S29 through S50, and when set to "1", the paper-passing mode operation is executed at steps S51 through S68.

(Copying Mode)

In the copying mode, first, whether the copy start flag is set to "1" or not is judged at step S29. When set to "1", the main motor M1 and the development motor M2 are turned on at step S30, and the static electricity charger 4, the transfer charger 6 and the exposure lamp 11 are turned on. Also, the copy start flag is reset to "0", and timers TA and TB are set. Then, which of the upper and lower paper feeders is selected is judged at steps S31 and S33; the paper feeding roller clutch of the paper feeder that has been selected at steps S32 and S34 is turned on; and the processing goes to step S35. When the copy start flag is judged to be set to "0" at said step S29, the processing goes to step S35 immediately.

When the finish of the judgement concerning the timer TA is confirmed at step S35, the paper feeding roller clutch is set to off-position at step S36. Also, when the finish of the judgement for the timer TB is confirmed at step S37, a scan signal of the optical system 10 is set to "1". This causes the optical system 10 to move in the direction of the arrow (b) to start the exposure of the image.

Then, whether a timing signal is set to "1" or not is judged at step S39. When set to "1", the clutch of the timing roller couple 28 is set to on-position at step S40, and a timer TC is set. When the finish of the judgement of the timer TC is confirmed at step S41, the static electricity charger 4 and the exposure lamp 11 are turned off at step S42; the scan signal is reset to "0"; and the clutch of the timing roller couple 28 is set to off-position.

Subsequently, whether a return signal of optical system 10 is set to "1" or not is judged at step S43. When set to "1", whether the multicopying operation is finished or not is judged at step S44. When not finished, the copy start flag is set to "1" at step S47, and the processing goes to step S48. When the multicopying operation is finished, whether the normal position signal is set to "1" or not is judged at step S45. This normal position signal is set to "1" when the optical system 10 has returned to its home position. Thus, when the normal position signal is set to "1", the development motor M2 and the transfer charger 6 are turned off, and a timer TD is set.

On the other hand, when the return signal is judged to have been reset to "0" at said step S43 and when the normal position signal is judged to have been reset to "0" at said step S45, the processing goes to step S48 immediately.

When the finish of the judgement of the timer TD is confirmed at step S48, the main motor M1 is turned off; the result of processing is outputted at step S49; and the processing returns to the main routine.

(Paper-Passing Mode)

The paper-passing mode serves for letting the identification sheets such as the colored sheets loaded in cassette 22 or 26 pass the copying machine 1 without having any image formed thereon.

First, whether the copy start flag is set to "1" or not is judged at step S51. When set to "1", the copy start flag is reset to "0" at step S52; the main motor M1 and the clutch of the timing roller couple 28 are turned on; and the timer TA is set. Then, which of the upper and lower paper feeders is selected is judged at steps S53 and S55. In this case, the paper feeder loaded with the identification sheets has been selected in advance; the paper feeding roller clutch of the paper feeder that has been selected at steps S54 and S56 is turned on, and the processing goes to step S57. When the copy start flag is judged to have been reset to "0" at said step S51, the processing goes to step S57 immediately.

When the finish of the judgement of the timer TA is confirmed at step S57, the paper feeding roller clutch is turned off at step S58, and a timer TE is set. Subsequently, when the finish of the judgement of the timer TE is confirmed at step S59, whether the feed of papers whose number corresponds to the number of copying is completed or not is judged at step S60. When not completed, the copy start flag is set to "1" at step S65, and the processing goes to step S66. When the feed of papers in number corresponding to the number of copying is completed, the clutch of the timing roller couple 28 is turned off at step S61. Further, the paper-passing flag is reset to "0" at step S62, and the paper-passing mode indication LED 68a is turned off at step S63. Then, the timer TD is set at step S64, and the processing proceeds to step S66.

When the finish of the judgement of the timer TD is confirmed at step S66, the main motor M1 is turned off at step S67; the result of the foregoing processing is outputted; and the processing returns to the main routine.

Figure 8:
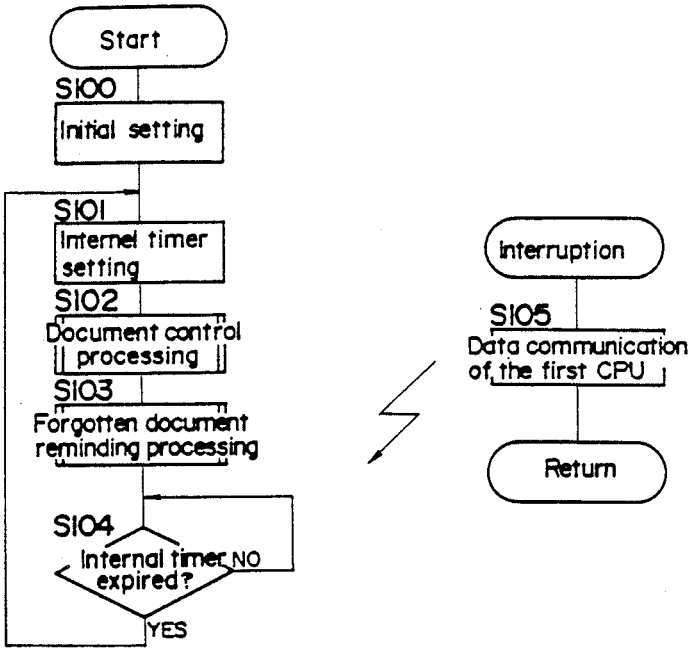
FIG. 8 is a flow chart showing a main routine of a fourth CPU.

FIG. 8 shows a main routine of the fourth CPU 84.

When the fourth CPU 84 is reset, and the program is started, the clearance of RAM, initialization of various registers and initialization of the ADF 50 for initial mode take place at step S100. Then, an internal timer whose value has been set by initial setting is started at step S101. Then, subroutines, which will be explained later, are called at steps S102 and S103. When these processings are finished, the processing returns to step S101 after the internal timer is expired at step S104. For each timer used in each subroutine, the count is made using the length of time required for one routine.

The data communication of the first CPU 81 is executed at step S105 through the request for interruption from the first CPU 81, irrespective of the main routine.

Figure 9:
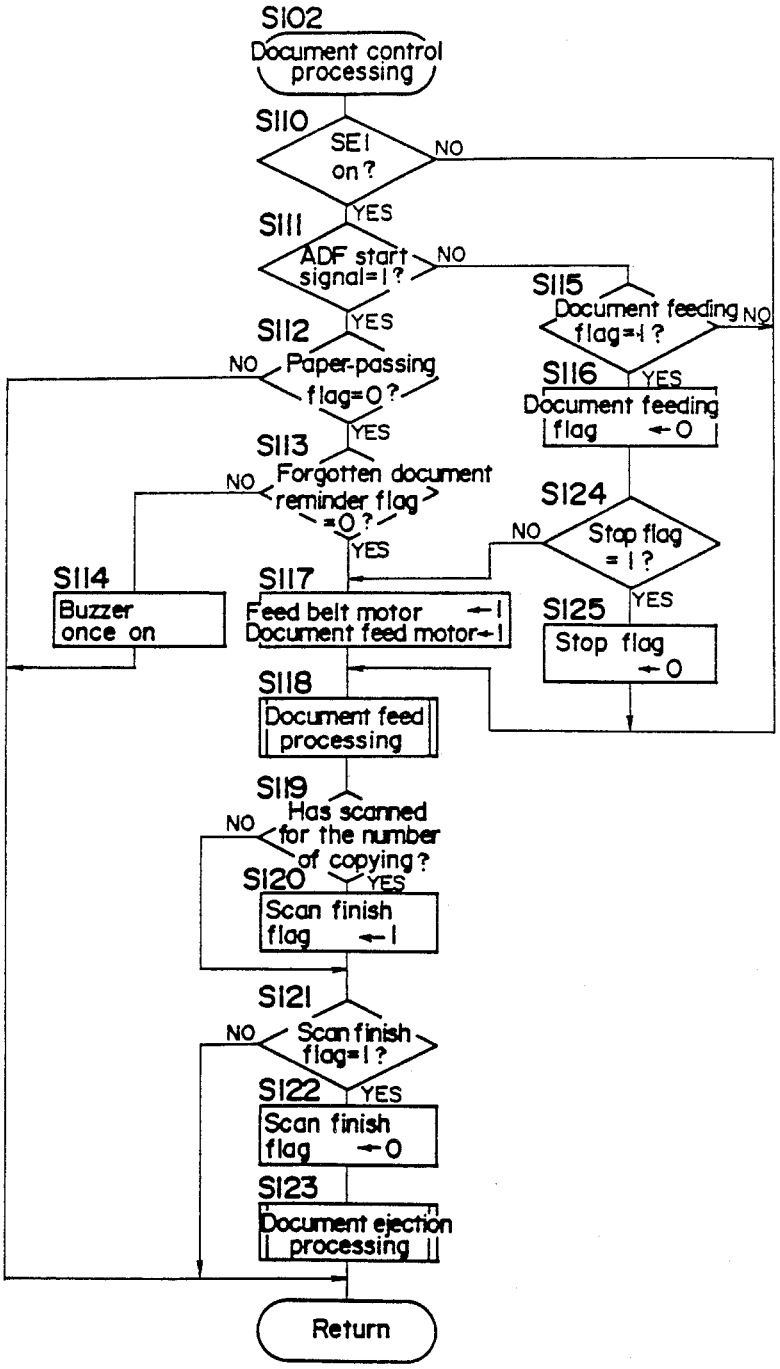
FIG. 9 is a flow chart showing a subroutine for a document control processing.

FIG. 9 shows a subroutine for the document control processing to be executed at step S102.

First, whether the document is on the document tray 51 or not is judged by on or off of the sensor SE1 at step S110. When the sensor SE1 is on indicating that the document is present, whether the ADF start signal is set to "1" or not is judged at step S111. When the ADF start signal is set to "1", whether the paper-passing flag is set to "0" or not is judged at step S112. When the paper-passing flag is set to "1", the processing returns to the main routine; when it is reset to "0", whether the forgotten document reminder flag is set to "0" or not is judged at step S123. When the normal copying operation is finished without using the ADF 50, the forgotten document reminder flag is set to "1" where the ADF 50 is closed. (Refer to steps S151 through S154), and said flag is reset to "0" where the ADF 50 is opened. That is, when the document is left on the document glass 9, the forgotten document reminder flag is set to "1". Thus, when the forgotten document reminder flag is reset to "0", the motors M5 and M6 are turned on at step S117 to drive and turn the feed belt 54 and the pickup roller 52 so that only one sheet of documents is fed from the document tray 51, and the processing proceeds to step S118.

On the other hand, when the forgotten document reminder flag is set to "1", the buzzer 53 is actuated once at step S114, and the processing returns to the main routine. That is, when the ADF 50 is attempted to be started without removing the document from the document glass 9, an alarm is issued to remind the operator of the forgotten document and prevent the other document from being fed.

When the ADF start signal is judged to have been reset to "0" at said step S111, whether the document feeding flag is set to "1" or not is judged at step S115. This document feeding flag is set to "1" where the document is left on the document tray 51 even after the operation for removing the document glass 9 has been completed (refer to step S141). Then, whether the stop flag is set to "1" or not is judged at step S124. When reset to "0", the motors M5 and M6 are turned on at step S117, and the processing proceeds to step S118. When the stop flag is set to "1", or when the clear/stop key 64 is on, the stop flag is reset to "0" at step S125, and the processing goes to step S118. In this case, the document is not fed.

On the other hand, when the sensor SE1 is off, and document is judged to be not present on the document tray 51 at said step S110, or when the document feeding flag is judged to have been reset to "0" at step S115, the processing proceeds to step S118 without starting the feed of document.

At step S118, a subroutine for processing concerning the feed of document, which will be explained later, is executed, and whether the optical system 10 has scanned for the number of times corresponding to the number of copies required or not is judged at step S119. When the scanning for the number of times corresponding to the number of copies required has not been completed, the processing proceeds to step S121, and, when the processing is completed, the scan finish flag is set to "1" at step S120. Then, whether the scan finish flag is set to "1" or not is judged at step S121. When not set to "1", said flag is reset to "0" at step S122, and a subroutine for the ejection of document, which will be explained later, is executed at step S123. When the scan finish flag is judged to have been reset to "0" at step S121, this subroutine is terminated.

Figure 10:
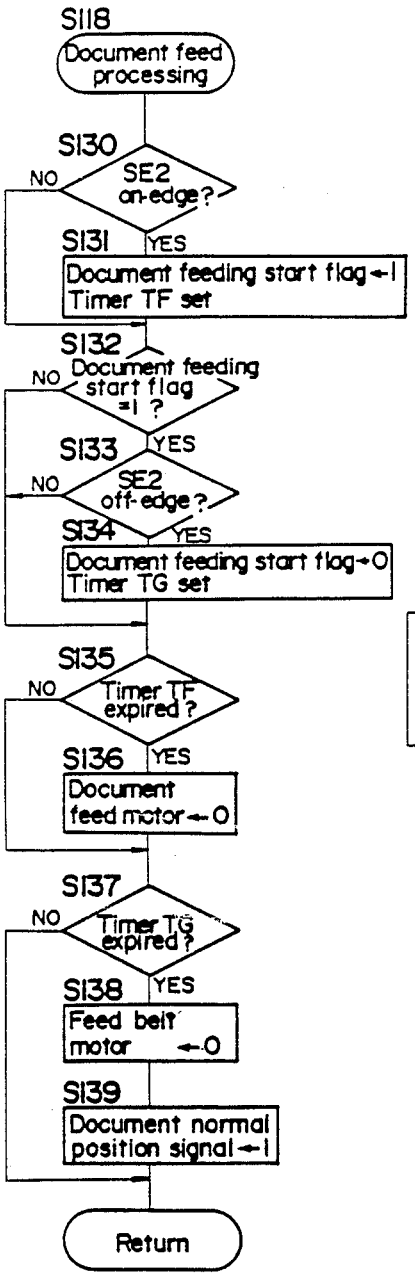
FIG. 10 is a flow chart showing a subroutine for a document feed processing.

FIG. 10 shows a subroutine for the document feed processing to be executed at step S118.

First, when the sensor SE2 is judged to be on-edge at step S130, or when the front end of the document fed from the document tray 51 is detected by the sensor SE2, the document feeding start flag is set to "1" at step S132, and a timer TF is started. Subsequently, whether the document feeding start flag is set to "1" or not is judged at step S132. When set to "1", the document feeding start flag is reset to "0" at step S134 after the sensor SE2 has become off-edge at step S133, or when the rear end of the document has passed the sensor SE2, and a timer TG is started.

Then, when the finish of the judgement of the timer TF is confirmed at step S135, the document feeding motor M5 is turned off at step S136. Further, when the finish of the judgement of the timer TG is confirmed at step S137, the feed belt motor M6 is turned off at step S138. This causes the document to be set on the specified position on the document glass 9. The document normal position signal is set to "1" at step S139 in order to be transmitted to the first CPU 81, and the processing returns to the main routine.

Figure 11:
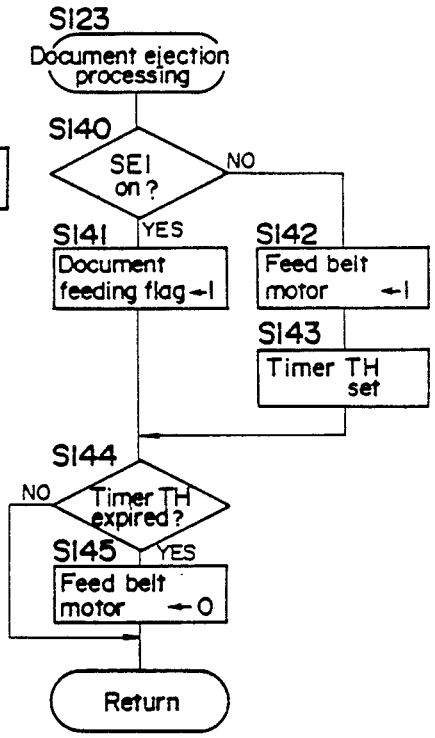
FIG. 11 is a flow chart showing a subroutine for a document ejection processing.

FIG. 11 shows a subroutine for the processing of the document ejection to be executed at step S123.

First, whether the document is on the document tray 51 or not is judged by on or off of the sensor SE1. When the sensor SE1 is on indicating the presence of the document, the document feeding flag is set to "1" at step S141, and the processing proceeds to step S144. When the sensor SE1 is off indicating the absence of the document, the feed belt motor M6 is turned on at step 142; a timer TO is started at step S143; and the processing goes to step S144. That is, when the document is on the document tray 51, the document is ejected simultaneously with the feed of the next document, and when the document is absent, the document is ejected by turning on the motor M6 independently only for this purpose.

Then, when the finish of the judgement of the timer TO is confirmed at step S144, the feed belt motor M6 is turned off at step S145, and the processing returns to the main routine.

Figure 12:
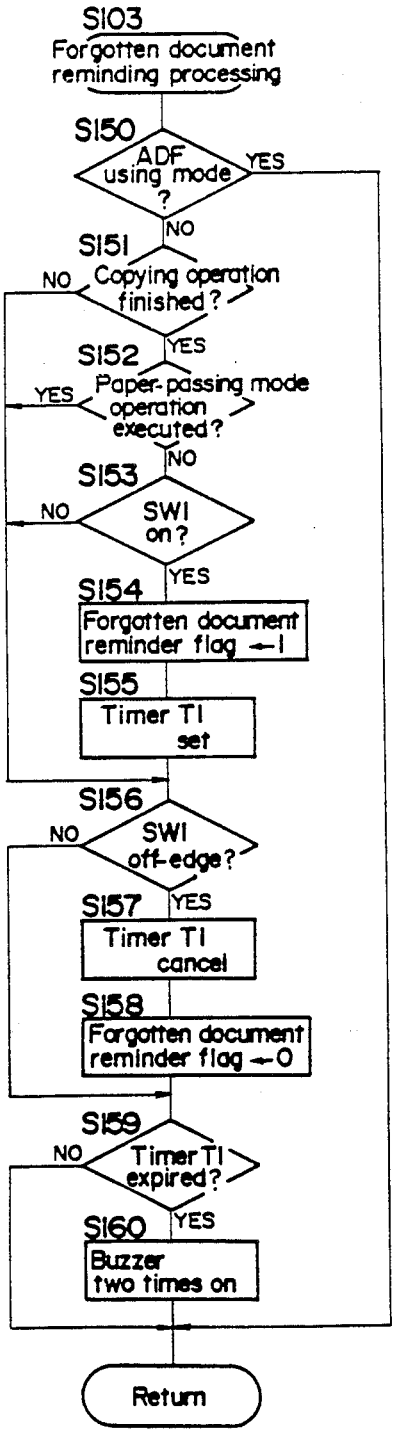
FIG. 12 is a flow chart showing a subroutine for a forgotten document reminding processing.

FIG. 12 shows a subroutine for the forgotten document reminding processing to be executed at step S103.

In this subroutine, first, whether the ADF 50 is used or not is judged at step S150; when not used, the processing returns to the main routine immediately. When the ADF 50 is used, whether the copying operation is finished or not is judged at step S151; when finished, whether the paper-passing mode operation has been executed or not is judged at step S152. When the paper-passing mode operation has been executed, whether the switch SW1 is on or off, or whether the ADF 50 is closed or not, is judged at step S153. When the ADF 50 is closed, the forgotten document reminder flag is set to "1" at step S154, and a timer TI is started at step S155.

Then, when the switch SW1 is found to be off-edge at step S156, or when the document glass 9 is opened by lifting the ADF 50, the timer TI is canceled at step S157, and the forgotten document reminder flag is reset to "0" at step S158. Subsequently, when the finish of the judgement of the timer TI is confirmed at step S159, the buzzer 53 is actuated two times at step S160 to remind the operator of the forgotten document.

That is, when the copying operation is executed in the copying mode without using the ADF 50, and the document glass 9 is not opened even after the time set by the timer TI has expired, the alarm is issued for reminding the operator of the forgotten document. When the paper-passing mode operation has been executed, however, no document is left on the document glass 9, so that no alarm will be issued, and the operation of the ADF 50 will not be inhibited. Similarly, even while the ADF 50 is in use, the document is ejected automatically, so that no alarm will be issued.

Although the present invention has been described in connection with the preferred embodiment thereof, it is to be noted that various changes and modifications are apparent to those skilled in the art. Such changes and modification are to be understood as included within the scope of the present invention as defined by the appended claims, unless they depart therefrom.

What is claimed is:

1. A copying apparatus, comprising:

a document glass;

a document pressing means that can be opened and closed to the document glass;

means for feeding copying papers;

means for storing image formed papers;

image forming means that is operable not only in a first operation mode wherein the image of the document set on the document glass is formed onto the copying paper fed by the copying paper feeding means, and the image formed paper is ejected into the storing means, but may also be selectively operated in a second operation mode wherein the copying paper fed by the copying paper feeding means is ejected into the storing means without forming the image of the document;

means for detecting the opening action of the document pressing means;

means for raising an alarm upon the failure to detect the opening action of the document pressing means after the image forming operation; and means for inhibiting the operation of the alarm means after the image forming operation in the second operation mode.

2. A copying apparatus defined in claim 1, wherein the alarm means issues the alarm when the detecting means has failed to detect the opening action of the document pressing means within a specified period of time following the completion of the operation of the image forming means.

3. A copying apparatus defined in claim 1, wherein the document pressing means serves as an automatic document feeder.

4. A copying apparatus defined in claim 1, wherein the storing means serves as a sorter.

5. A copying apparatus, comprising: a document glass;

means for feeding copying papers;

means for storing image formed papers;

image forming means that is operable not only in a first operation mode wherein the image of the document set on the document glass is formed onto the copying paper fed by the copying paper feeding means, and the image formed paper is ejected into the storing means, but may also be selectively operated in a second operation mode wherein the copying paper fed by the copying paper feeding means is ejected into the storing means without forming the image of the document;

means for detecting and sending an alarm if a document is left on the document glass after the operation of the image forming means has been completed; and means for inhibiting the operation of the alarming means after the operation of the image forming means in the second operation mode has been completed.

6. A copying apparatus defined in claim 5, further comprising a document pressing means that can be opened and closed to the document glass and means for detecting the opening action of the document pressing means.

7. A copying apparatus defined in claim 5, wherein the alarming means detects and alarms of the document left on the document glass when the detecting means has failed to detect the opening action of the document pressing means within a specified period of time after the image forming means has completed its operation.

8. A copying apparatus, comprising:

a document glass;

an automatic document feeder that is free to open and close with respect to the document glass and capable of setting the document on the document glass;

means for feeding copying papers;

means for storing image formed papers;

image forming means that is operable not only in a first operation mode wherein the image of the document set on the document glass by the automatic document feeder is formed onto the copying paper fed by the paper feeding means, and the image formed paper is ejected into the storing means, but may also be selectively operated in a second operation mode wherein the image of the document set on the document glass by the operator is formed onto the copying paper fed by the paper feeding means, and the image formed paper is ejected into the storing means, and in a third operation mode wherein the copying paper fed by the paper feeding means is ejected into the storing means without having the image formed thereon;

means for detecting the open and close actions of the automatic document feeder;

first control means for inhibiting the operation of the image forming means in the first operation mode when the detecting means has not detected the open or close action of the automatic document feeder after the operation of the image forming means in the second operation mode has been completed; and second control means for overriding the inhibiting means so as to permit the operation of the image forming means in the first operation mode, irrespective of a signal detected by the detecting means, after the operations of the image forming means in the third operation mode has been completed.

9. A copying apparatus defined in claim 8, wherein the storing means serves as a sorter.

10. A copying apparatus defined in claim 8, wherein the first control means permits the operation of the sorter.

11. A copying apparatus comprising:

a document glass;

an automatic document feeder for setting a document on the document glass;

means for feeding copying papers;

means for storing image formed papers;

image forming means that is operable not only in a first operation mode wherein the image of the document set on the document glass by the automatic document feeder is formed onto the copying paper by the paper feeding means, and the image formed paper is ejected into the storing means, but may also be selectively operated in a second operation mode wherein the image of the document set on the document glass by the operator is formed onto the copying paper fed by the paper feeding means, and the image formed paper is ejected into the storing means, and in a third operation mode wherein the copying paper fed by the paper feeding means is ejected into the storing means without having the image formed thereon;

means for manually selecting the operation mode of the image forming means;

means for manually inputting a copy start instruction;

first control means, responsive to said instruction in the first operation mode, for actuating the automatic document feeder, paper feeding means and image forming means; and second control means, responsive to said instruction in the third operation mode, for inhibiting the operation of the automatic document feeder while permitting the operations of the paper feeding means and the image forming means so that copying paper fed by the paper feeding means is ejected into the storing means without having the image of the document formed thereon.

12. A copying apparatus defined in claim 11, further comprising a means for reminding the operator of the document left on the document glass.

* * * * *